US006022269A

United States Patent [19]

Arbucci

[11] Patent Number: 6,022,269

[45] Date of Patent: Feb. 8, 2000

[54] STACKABLE CHIMNEY CAP

[75] Inventor: Christopher B. Arbucci, Massapequa, N.Y.

[73] Assignee: Christopher Arbucci, Massapequa, N.Y.

[21] Appl. No.: 09/300,235

[22] Filed: Apr. 27, 1999

[51] Int. Cl.[7] ..... F23L 17/02

[52] U.S. Cl. ..... 454/12; 454/35

[58] Field of Search ..... 454/12, 13, 35

[56] References Cited

U.S. PATENT DOCUMENTS

| | | | |
|---|---|---|---|
| Re. 27,943 | 3/1974 | Smith . | |
| D. 246,464 | 11/1977 | Brazell . | |
| 462,127 | 10/1891 | Hanson . | |
| 494,454 | 4/1893 | Ashton . | |
| 555,643 | 3/1896 | Gordon . | |
| 678,083 | 7/1901 | Witte . | |
| 850,126 | 4/1907 | Bayley . | |
| 920,763 | 5/1909 | Lauritzen . | |
| 1,340,033 | 5/1920 | Fojtik | 454/12 X |
| 1,588,321 | 6/1926 | Lord . | |
| 2,229,212 | 1/1941 | Kreutzer . | |
| 2,582,905 | 1/1952 | Harmon . | |
| 2,766,678 | 10/1956 | Morris . | |
| 2,805,616 | 9/1957 | Roth | 454/35 X |
| 2,821,900 | 2/1958 | Primich . | |
| 2,956,495 | 10/1960 | Sublette . | |
| 2,976,796 | 3/1961 | Anthony et al. | 454/14 |
| 3,089,521 | 5/1963 | Paiement . | |
| 3,173,354 | 3/1965 | Kinkead et al. . | |
| 3,232,207 | 2/1966 | Gibbons . | |
| 3,345,932 | 10/1967 | Sauer . | |
| 3,363,369 | 1/1968 | Miller . | |
| 3,363,538 | 1/1968 | Stoneman et al. . | |
| 3,631,789 | 1/1972 | Kinsey . | |
| 3,685,426 | 8/1972 | Rosa . | |
| 4,007,759 | 2/1977 | Martin et al. . | |
| 4,202,255 | 5/1980 | McNamara . | |
| 4,334,460 | 6/1982 | Simmons et al. . | |
| 4,436,021 | 3/1984 | Hisey . | |
| 4,549,473 | 10/1985 | Alexander et al. | 454/14 |
| 4,593,510 | 6/1986 | Newsome . | |
| 4,686,807 | 8/1987 | Newsome . | |
| 4,697,500 | 10/1987 | Hisey | 454/12 X |
| 4,731,967 | 3/1988 | McLaughlin . | |
| 4,732,078 | 3/1988 | Giumenta et al. | 454/12 X |
| 4,811,534 | 3/1989 | Newsome . | |
| 4,846,147 | 7/1989 | Townsend et al. . | |
| 4,909,135 | 3/1990 | Greko . | |
| 4,955,167 | 9/1990 | Holtgreve . | |
| 5,003,739 | 4/1991 | Newsome . | |
| 5,402,613 | 4/1995 | Giumenta et al. | 454/12 X |

FOREIGN PATENT DOCUMENTS

| | | |
|---|---|---|
| 2 614 675 | 11/1988 | France . |
| 721 849 | 1/1955 | United Kingdom . |

OTHER PUBLICATIONS

Photos of article of manufacture which, upon information and belief, is a prior art "public use."

*Primary Examiner*—Harold Joyce
*Attorney, Agent, or Firm*—Baker & Botts, LLP

[57] ABSTRACT

A stackable chimney cap includes a stackable cage/base unit composed of four parts, each part being formed by bending from a blank of metal sheet and the four parts being permanently joined together by weldments. Trapezoidal-shaped, perforated side walls of the four parts together form a pyramidal cage portion of the cage/base unit having a rectangular opening at a planar base edge thereof. Bent flange portions on each part together form a peripheral mounting base portion of the chimney cap that extends outwardly from the base edge of the cage portion with respect to the base opening. A stackable hood separate from the cage/base unit is attached to the upper edge of the cage portion at the point of sale or use of the chimney cap. Several chimney caps, with the cage/base units and hoods stacked separately, can be boxed together for storage, shipment and retail stocking, using a fraction of the space required for the same number of fully assembled chimney caps of the same size.

8 Claims, 8 Drawing Sheets

STACKABLE CHIMNEY CAP

RELATED APPLICATIONS

The present application is related to U.S. Pat. No. 5,876,276, entitled "COLLAPSIBLE CHIMNEY CAP," of Arbucci and U.S. patent application Ser. No. 08/947,518, entitled "CHIMNEY CAP HOOD" of Arbucci, both of which are hereby incorporated by reference for all purposes.

FIELD OF INVENTION

The present invention is a stackable chimney cap that can be packed, shipped and stored in a space-efficient manner.

BACKGROUND OF THE INVENTION

Chimney caps are widely used on the tops of chimney flues to prevent, or at least restrict, entry of rain, snow, hail, leaves, small animals and other undesirable substances and objects into the chimney flue. Chimney caps also prevent birds and squirrels from nesting in an infrequently used chimney. Conventional chimney caps are usually made from sheet metal and include a mounting base portion that is configured to enable the chimney cap to be fitted over and attached to the upper edge of the chimney flue, a perforated cage portion that extends upwardly from the mounting base portion and allows smoke to pass from the flue to the ambient atmosphere but keeps out birds, squirrels, leaves and the like, and a roof that covers the outlet of the flue and restricts the entry of precipitation into the flue. A common way of manufacturing the mounting base and cage portions is by bending a single sheet or blank of metal into the four sides in succession and joining the opposite ends of the bent blank. The roof of the cap is typically welded to the upper ends of the four sides of the cage portion to form a single finished unit. In some chimney caps, the mounting base portion includes inwardly extending flanges that are formed integrally or formed separately and welded to the bottom edge of each side of the cage portion to form a shelf, which is received on top of the chimney flue and supports the cap. The cap is secured by screws on each side of the mounting base portion to hold the cap in place on the flue.

Most chimney caps are preassembled by the manufacturer to create large single units. The manufactured caps when assembled are very bulky for purposes of both storage and shipment. Boxed, assembled caps will take up a large amount of costly space in storage warehouses and retail stores and cargo space in trucks when transported. The individual boxing of fully assembled chimney caps also involves high costs for boxes and the labor costs of individual boxing.

It is also previously known to produce and sell chimney caps in disassembled or kit form, which are assembled at the point of sale or installation. One such chimney cap kit is described and shown in U.S. Pat. No. 5,876,276. A kit form of chimney cap is usually shipped in multiple pieces, typically including four individual side pieces and a hood, along with screws for securing the cap to the chimney flue and nuts and bolts for attaching the hood to the four side walls. The hood is typically connected to each of the side walls by placing the bolt through the sidewall and the hood and installing a nut on the bolt. Welding operations are, of course, not practical for assembling a chimney cap kit at the point of sale or installation.

Chimney caps sold in disassembled or kit form save significant storage and shipping space, which in turn reduces the costs associated with the distribution of the caps.

However, because the separate cap side walls are assembled using screws, they generally lack the structural integrity of a welded cap and require additional costs for assembly, whether at the point of purchase or the place of installation.

There is a need for a chimney cap that has the strength and durability of a factory-assembled cap, preferably of a welded construction, that does not require time-consuming assembly operations at the point of sale or installation, and that can be warehoused, shipped and stocked with a considerable reduction in the amount of space.

SUMMARY OF THE INVENTION

One object of the present invention is to provide a chimney cap that has the strength and durability of a fully factory-assembled chimney cap but can be stored, transported and stocked in a fraction of the space required for fully assembled chimney caps. Another object is to provide a chimney cap that can be assembled at the point of sale or use with ease and in significantly less time than is required for assembling a kit form of chimney cap. It is also an object to achieve, in addition to reductions in the costs associated with separate packaging of fully assembled chimney caps, further cost savings in the tooling and labor costs for manufacturing a chimney cap.

The foregoing and other objects are attained, in accordance with the present invention, by a stackable chimney cap that includes a stackable cage/base unit having a pyramidal-shaped cage portion that is composed of four interconnected side walls of perforated sheet material, each side wall being trapezoidal in plan and having a base edge of a length greater than the length of the top edge. The base edges lie in a base plane and define a rectangular (includes square) base opening. A mounting base portion is attached to the base edges of the side walls of the cage portion and is located entirely outwardly of the base opening of the cage portion. A stackable hood, which is separate from the cage/base unit, is attached to the upper edges of the side walls of the cage/base portion at the point of sale or use.

The pyramidal shape of the cage portion of the cage/base unit and the location of the mounting base entirely outside of the base opening of the cage portion permit a number of the cage/base units to be stacked in nested relation. The hoods for the chimney caps can be stacked separately and boxed with the stack of cage/base units or separately from the cage/base units for storage, shipment and retail stocking. The ability to stack the cage/base units and the hoods reduces the volume of a shipment of a given number of chimney caps to a small fraction of that required for the same number of fully assembled chimney caps of the same size. The manufacture of the cage/base units in unitary form allows them to be made strong and durable and considerably reduces the time and difficulty of assembly as compared to chimney caps of the kit form.

In advantageous embodiments, the mounting base portion of the cage/base unit includes a peripheral base flange lying substantially in the base plane of the cage portion and having an opening coextensive with the base opening of the cage portion and a peripheral edge flange dependent from the outer edge of the base flange. The flange configuration of the mounting base portion allows the cap to fit over the top rim of a chimney flue and provides sites in the edge flange for screws to clamp the chimney cap to the side walls of the flue.

The cage/base unit may be composed of four parts, each part including one side wall and a section of the mounting base portion coextensive with that side wall and the four parts being fastened to each other. Each of the four parts of the cage/base unit is, preferably, formed from a single blank of sheet metal such that the side wall and the section of the mounting base portion are integral and joined together along bending lines of the blank. The side wall of each part of the cage/base unit may have a connector flange, which is permanently connected to a portion of the side wall of an adjacent part by at least one weldment. Welding the parts together at the manufacturing facility enables the cage/base unit to be made strong and highly durable.

In preferred embodiments of the present invention, the edge flange of the flange section of each part is formed by a portion of the blank that is bent double on itself for enhanced rigidity. In particular, the edge flange of the flange section of each part is formed by an outer edge flange of the blank that is bent downwardly from the base flange and an inner edge flange that is bent inwardly and upwardly from a lower edge of the outer edge flange so as to double the outer edge flange. The inner edge flange may have a notch adjacent one end and a connector tab at the other end. The connector tab of the inner edge flange of each part is received in the notch of the inner edge flange of the adjacent part and is fastened by a weldment to the outer edge flange of that adjacent part. That arrangement both interconnects the section of the mounting base on each part to the adjacent part and connects the inner edge flange to the outer edge flange of the adjacent part, thus holding the inner edge flange more securely in doubled relation to the outer edge flange.

Preferred embodiments comprise a first pair of parts of the cage/base unit opposite each other that are identical and a second pair of parts of the cage/base unit opposite each other and located between the parts of the first pair that are also identical. When the cage unit is square in plan, all four parts of the cage/base unit are identical. The ability to use identical parts provides cost-savings in manufacture by reducing the amount of tooling required to make the parts.

Advantageously, each of the side walls of the cage portion may have a fastener-receiving tab by which the hood is fastened to the cage/base unit by fasteners received through the fastener-receiving tabs and the hood.

DESCRIPTION OF THE DRAWINGS

Further objects, features and advantages of the invention will become more apparent from the following detailed description of an embodiment of the invention, taken in conjunction with the accompanying drawings, in which.

Figure 1:
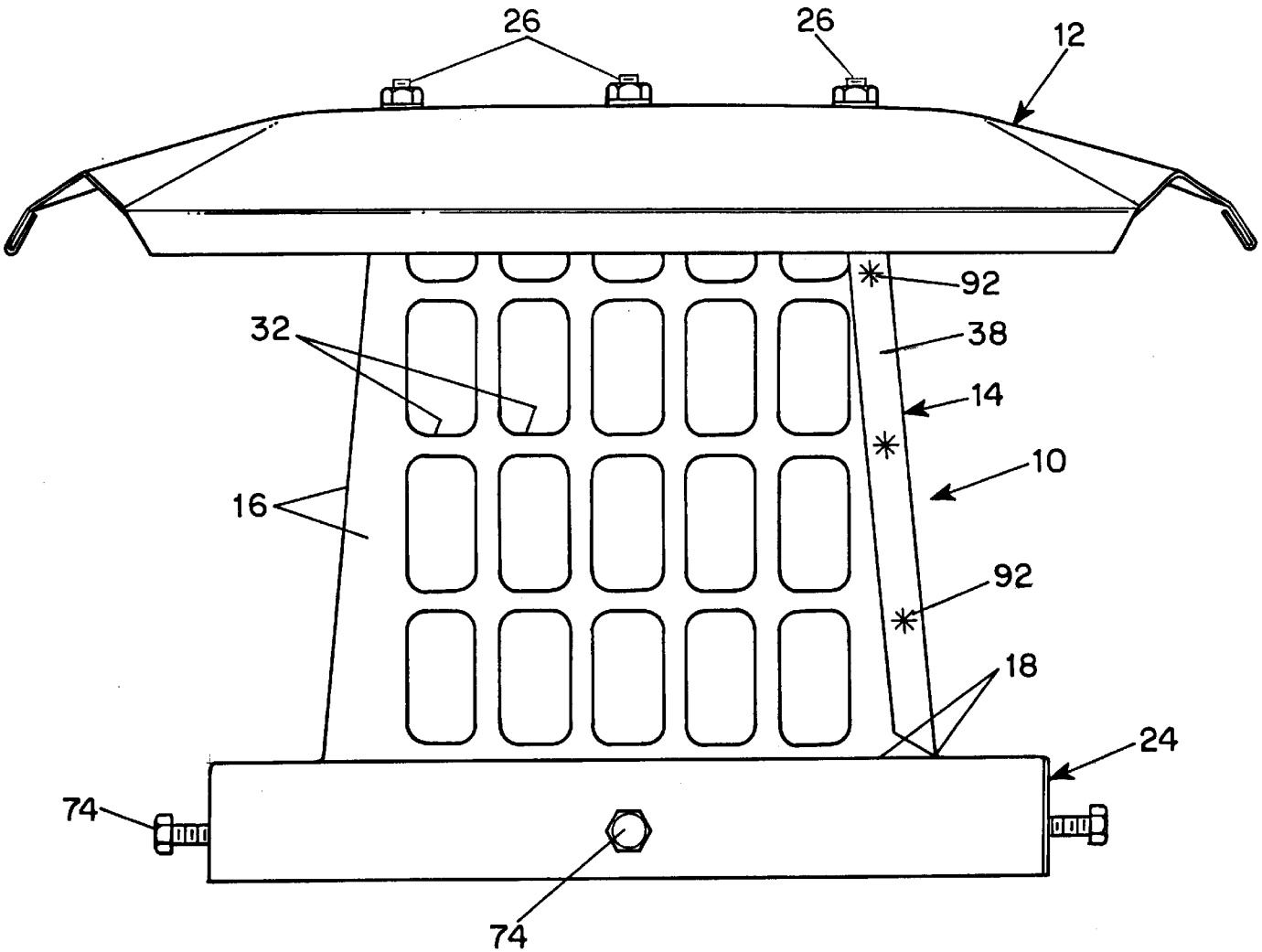
FIG. 1 is a side elevational view of a fully assembled stackable chimney cap according to the embodiment—all four sides of the embodiment are identical.

Throughout the figures, unless otherwise stated, the same reference numerals are used to denote like features, elements, components or portions of the illustrated embodiment. Moreover, while the embodiment of the present invention will now be described in detail with reference to the drawing figures, changes and modifications can be made in the described embodiment without departing from the true scope and spirit of the subject invention, as defined by the appended claims.

DESCRIPTION OF THE EMBODIMENT

The stackable chimney cap can be manufactured at a central facility and stacked within other chimney caps in order to minimize the storage and shipping space requirements. When chimney caps are produced in fully assembled condition, only one cap will fit in a box for storage, shipment, retail stocking and delivery to the site of installation. The stackable chimney cap of the present invention is formed in such a way to retain the strength and structural integrity of a pre-formed welded cap while reducing the requirement for space to a fraction of that required for fully assembled chimney caps.

Figure 6:
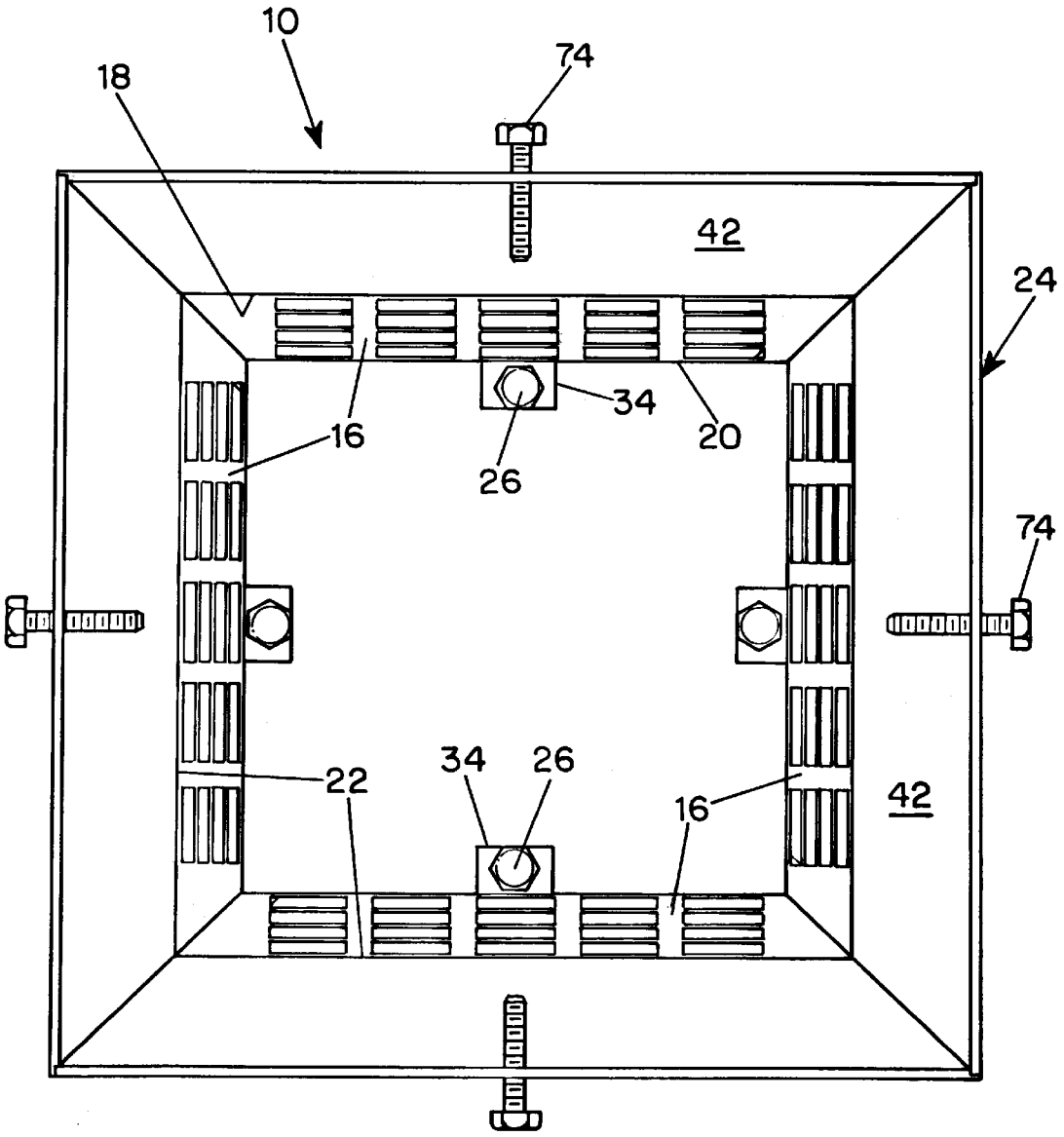
FIG. 6 is a bottom plan view of the cage/base unit.
Figure 7:
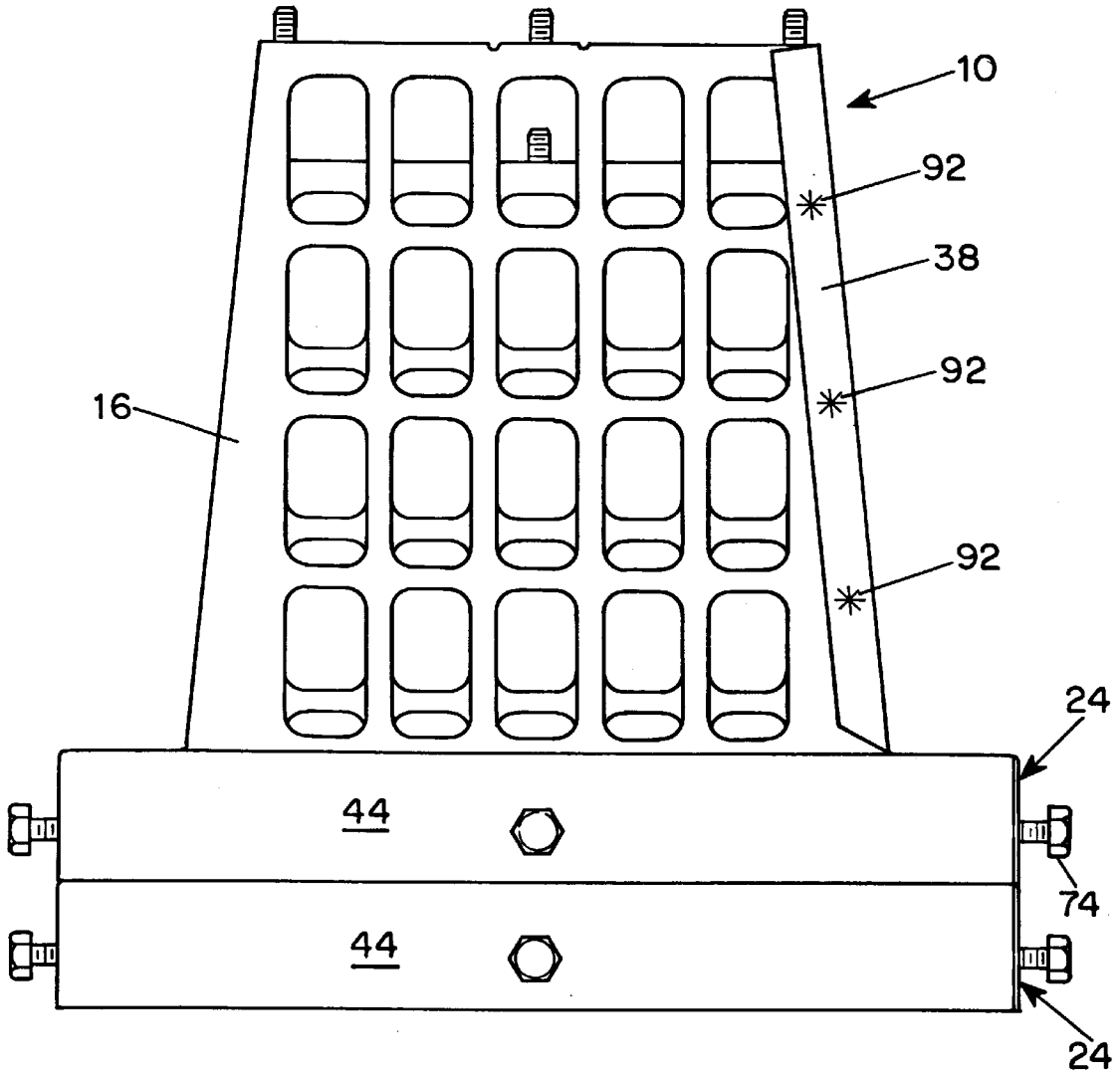
FIG. 7 is a side elevational view of two cage/base units stacked in nested relation.

The illustrated embodiment of a stackable chimney cap, according to the present invention, consists of a stackable cage/base unit 10 and a stackable hood 12. The cage/base unit 10 has a pyramidal-shaped cage portion 14 that is composed of four interconnected side walls 16 of perforated sheet material, each side wall 16 being trapezoidal in plan (see, e.g., FIG. 3) and having a base edge 18 of a length greater than the length of a top edge 20, and the base edges lying in a base plane (see, e.g., FIG. 4) and defining a rectangular base opening 22 (see, e.g., FIG. 6). A mounting base portion 24 is attached to the base edges 18 of the side walls 16 of the cage portion and located entirely outwardly of the base opening 22 of the cage portion. The hood 12, which is stackable separately from the cage/base unit 10 for storage, shipment and stocking, is attached by bolts/nuts 26 at the point of sale or at the site of installation.

The cage/base unit 10, which is square (a rectangle with four equal sides) in plan, is factory-assembled from four identical parts, each of which is in turn made by cutting and punching a blank 30 of sheet metal, stainless steel being preferred, and then bending the blank to a shape suited for assembly. Chimney caps that have unequal sides may be made from two pairs of parts, the parts of each pair being identical to each other and the parts of the two pairs differing only in width.

The blank 30 (see FIG. 2) has the following portions:

- a trapezoidal side wall 16, punched with openings 32;
- a hood connector tab 34, which extends from the top edge 20 of the side wall 16 and has a hole 36 for a bolt of the bolt/nut 26 by which the hood 12 is later attached to the cage/base unit 10;
- a side wall-connector flange 38, by which each side wall 16 of each part of the cage/base unit is joined to the side wall of an adjacent part;
- a mounting base flange section 40, which has, in turn, the following portions:
  - a trapezoidal base flange 42;
  - an outer side flange 44; and
  - an inner side flange 46, which has a notch 48 in one corner and a side flange-connector tab 50 extending from the other corner.

Figure 2:
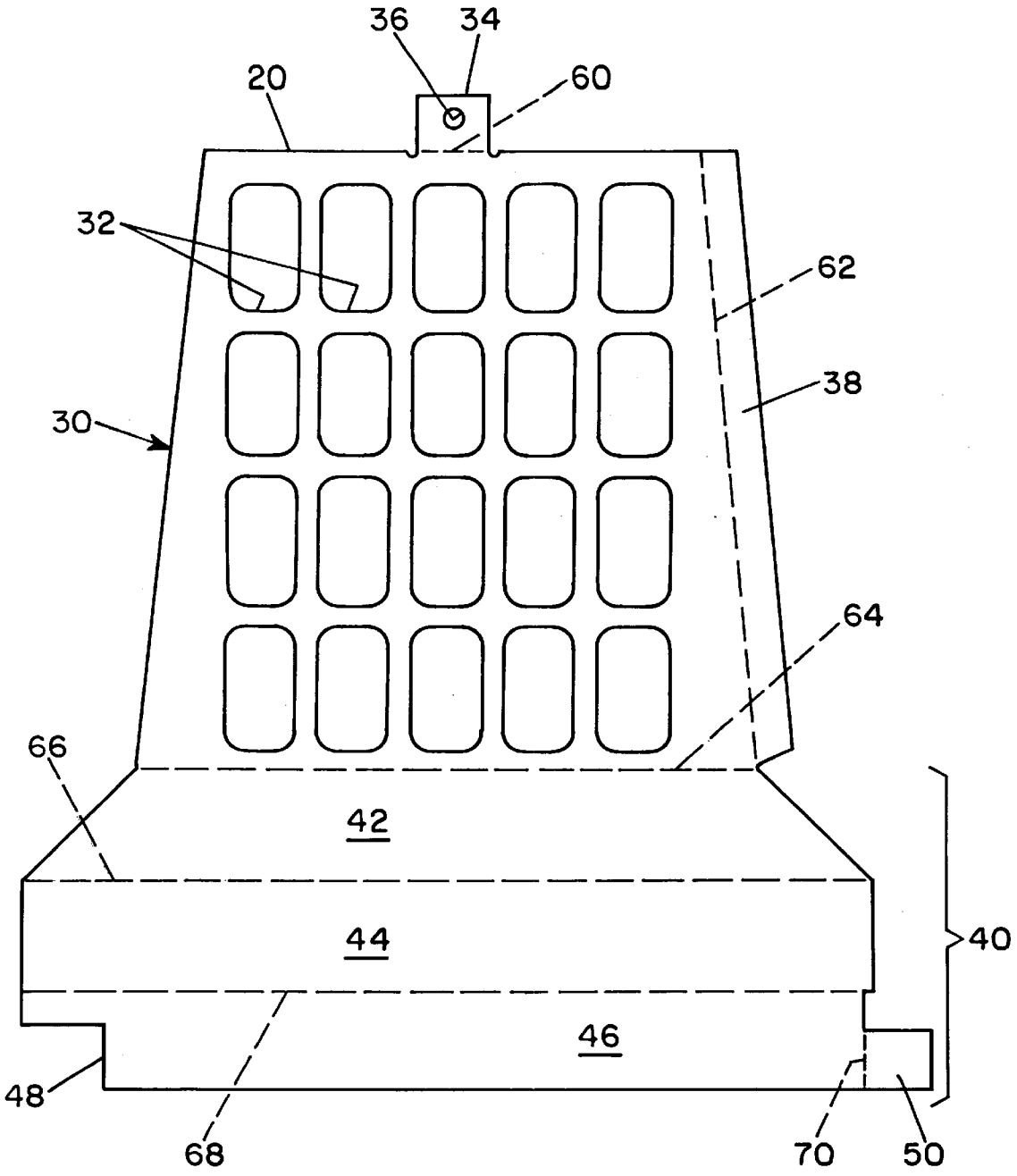
FIG. 2 is a plan view of a blank from which each of the four parts of the cage/base unit of the embodiment is formed.
Figure 3:
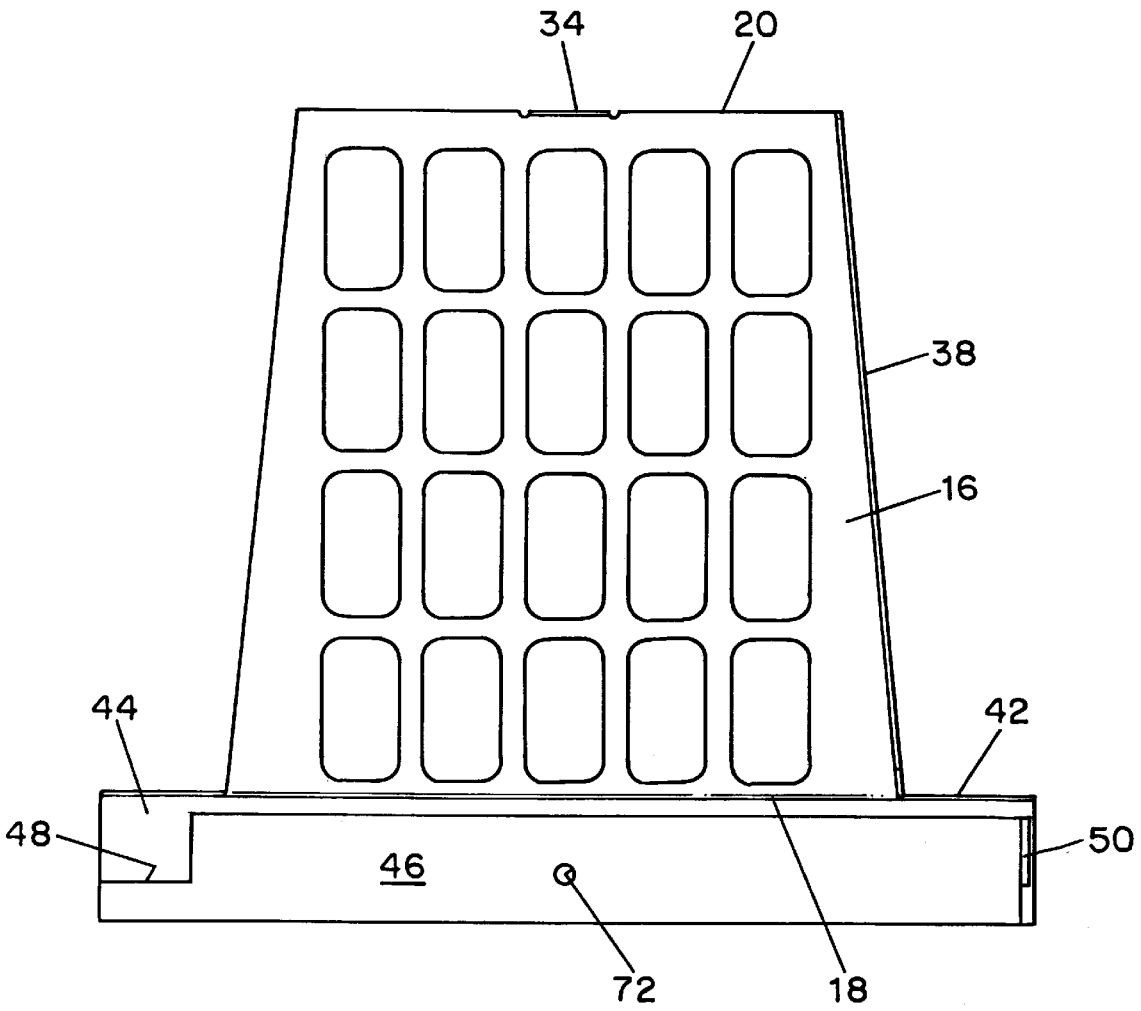
FIG. 3 is an elevational view of the blank after it has been bent into the form in which it is assembled, the view being of the side that faces inwardly.
Figure 4:
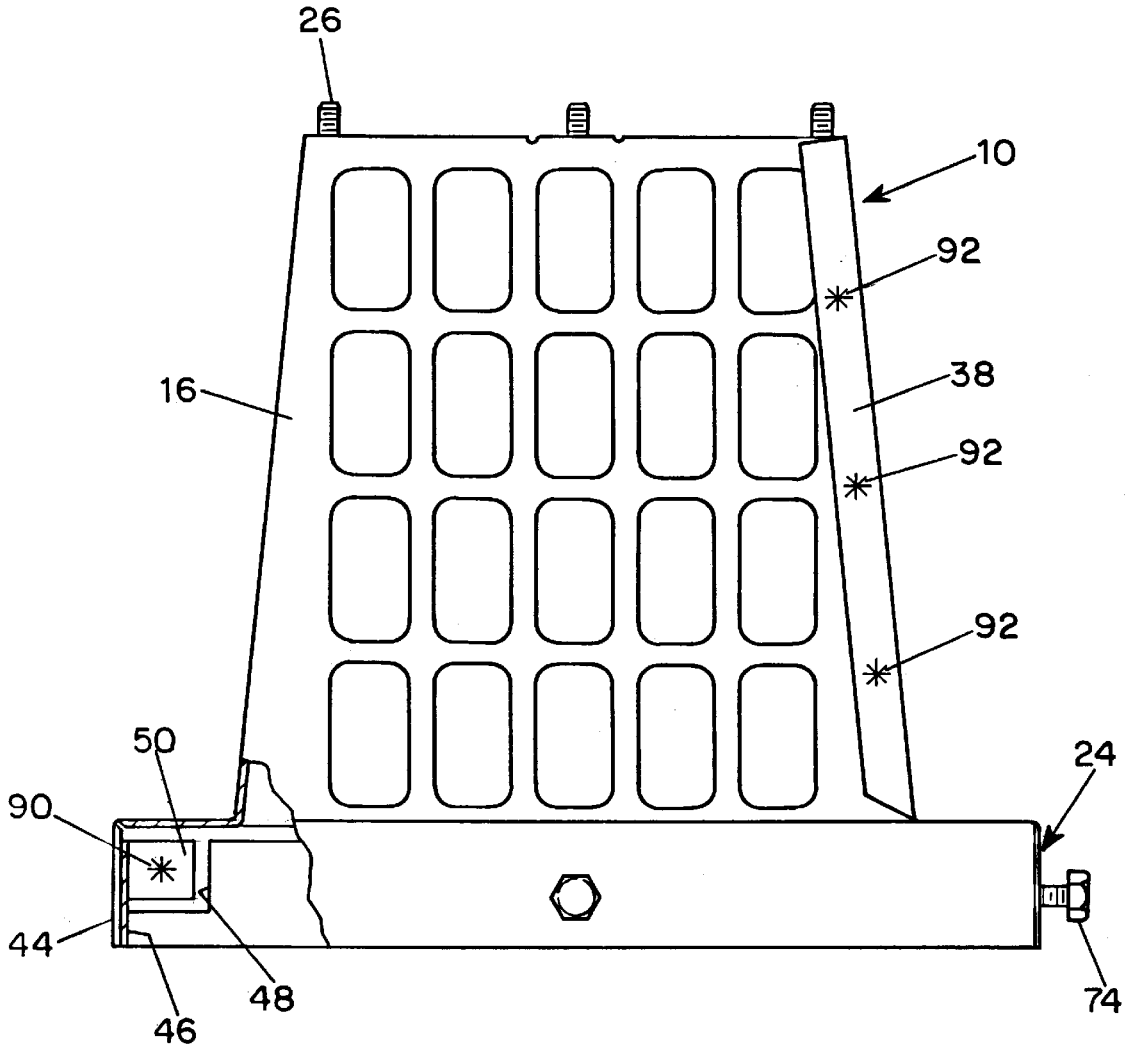
FIG. 4 is a side elevational view of an assembled cage/base unit, a portion being broken away to show how the base portions of the unit are joined.
Figure 5:
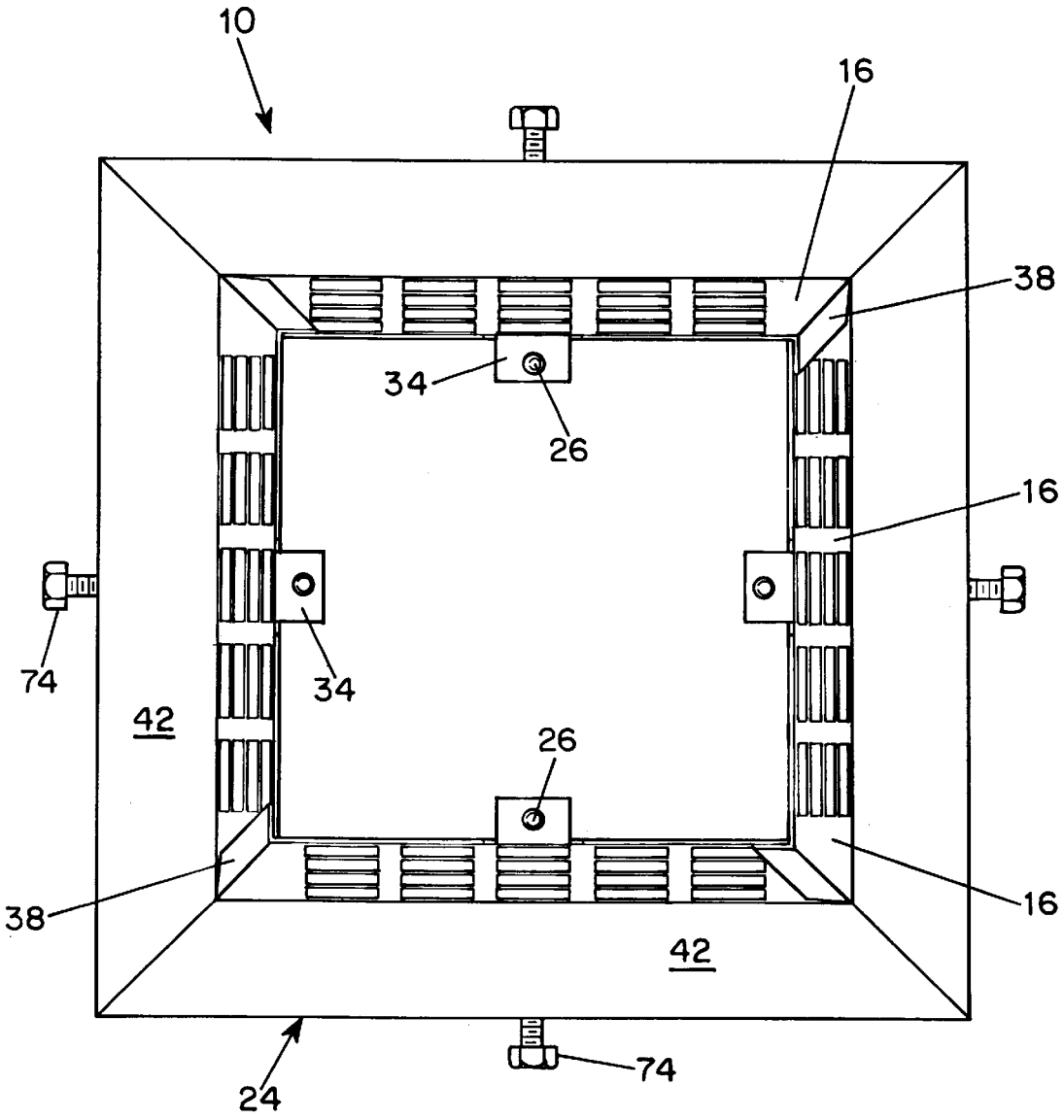
FIG. 5 is a top plan view of the cage/base unit.

The blank 30 is bent along the dashed lines of FIG. 2 to yield the final part that is shown in FIG. 3; to wit:

- the tab 30 is bent inwardly (toward the viewer from the plane of the drawing sheet) along the bending line 60;
- the connector flange 38 is bent inwardly along the bending line 62;

the base flange 42 is bent outwardly (into the sheet away from the viewer of FIG. 3) along the bending line 64;

the outer side flange 44 is bent downwardly from the base flange along the bending line 66;

the inner side flange 46 is bent upwardly along the bending line 68 so that it lies flat against the outer side flange, thus doubling the side flange of the mounting base portion 24 of the cage/base unit 10 for enhanced stiffness; and the connector tab 50 is bent inwardly (out from the sheet toward the viewer of FIG. 3) along the bending line 70.

At this point, a hole 72 is punched in the double side flange 44/46 for a bolt 74 by which the chimney cap is fastened to the upper rim of a chimney flue.

Note that the notch 48 in the inner side flange 46 leaves a corner portion of the outer side flange 44 exposed. When the four parts formed from four bent blanks 30 are assembled to produce the cage/base unit 10, the connector tab 50 of each part fits within the notch 48 of the adjacent part and engages the exposed corner portion of the outer side flange 44. As may be seen in the broken away portion of FIG. 4, the connector tab 50 is fastened to the exposed part of the outer side flange 44 by a spot weld 90. That arrangement of the doubled-thickness flange improves the strengths of the junctures of the base flange sections 40 of the parts of the cage/base unit 10 and allows the tabs 50 to lie flush with the inner side flange 46 of the adjacent cage/base unit part to which the tab 50 is joined.

The skilled viewer of the drawings, considered in the light of the foregoing description, will readily see how the four parts interconnect. Suffice it to refer to the spot welds 92 by which the connector flange 38 of each bent blank part of the cage/base unit 10 is fastened to an edge portion of the side wall 16 of an adjacent part. The cage/base unit 10 will be understood by those skilled in the art to be of high strength and durability and, having been fully constructed in a factory, will have adhered to high dimensional tolerances.

Figure 8:
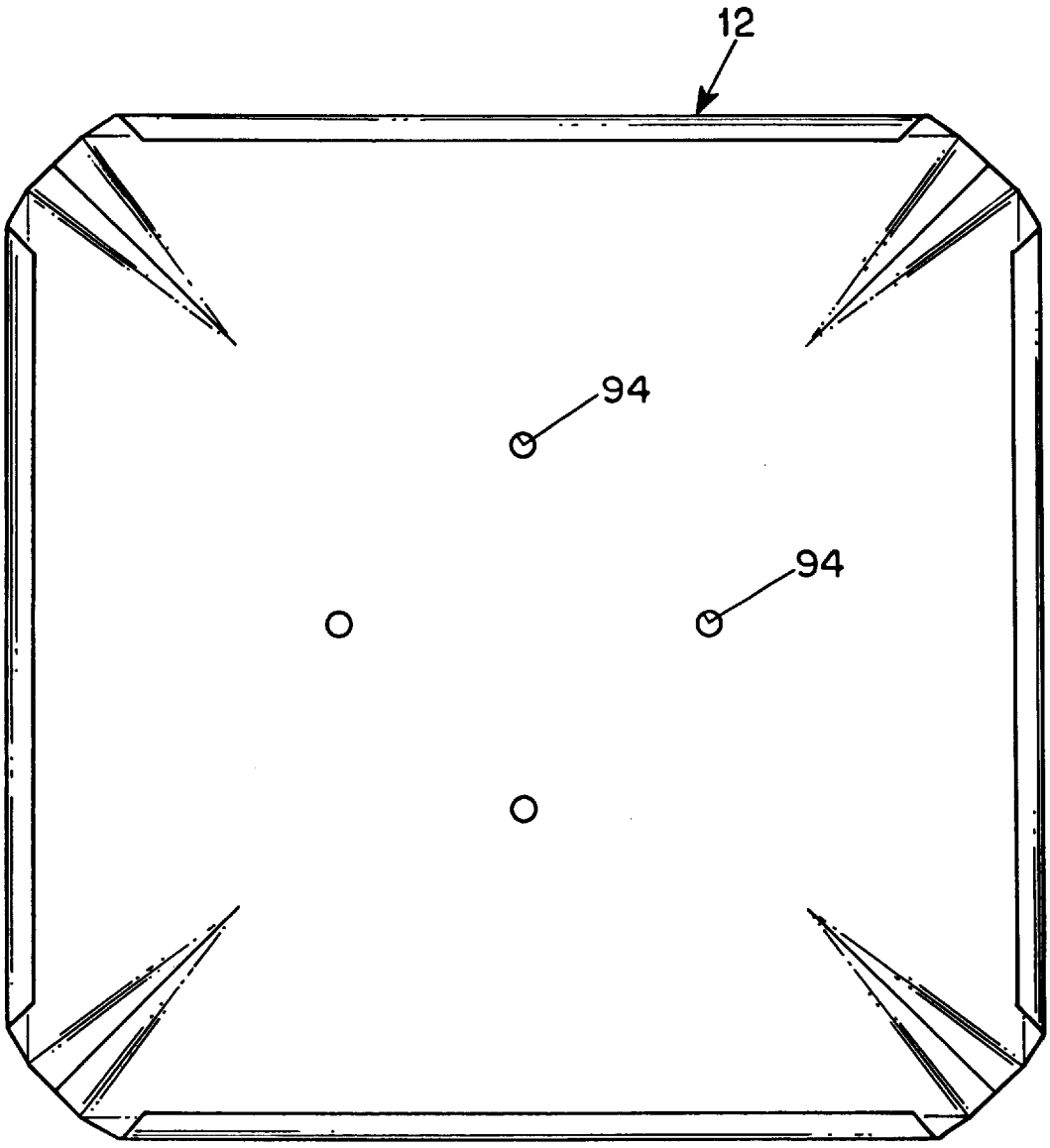
FIG. 8 is a bottom plan view of the hood of the embodiment.

The hood 12 (FIG. 8) is shaped from a blank of sheet metal, stainless steel being preferred, and punched with holes 94 for the bolts/nuts 26.

The foregoing merely illustrates the principles of the invention. It will thus be appreciated that those skilled in the art will be able to devise numerous systems, apparatus and methods which, although not explicitly shown or described herein, embody the principles of the invention and are thus within the spirit and scope of the invention as defined by the appended claims.

For example, different materials, such as composite plastics, can also be used to create the pieces for the chimney cap.

What is claimed is:

1. A stackable chimney cap comprising a stackable cage/base unit composed of four parts, each part being formed from a blank of metal sheet and having a perforated trapezoidal side wall section, a base flange section and an outer side flange section, the four parts being permanently joined together with said side wall portions forming a pyramidal cage portion having a larger rectangular base opening at a planar base edge thereof and a smaller rectangular opening at a top edge thereof, the base flange sections forming a base flange portion extending outwardly from the base edge with respect to the base opening, and the outer side flange sections forming an outer side flange portion extending substantially perpendicularly from a periphery of said base flange portion in a direction away from the cage portion; and a hood separate from the cage unit and adapted to be attached to the cage portion.

2. A stackable chimney cap according to claim 1, wherein the base flange portion substantially resides in plane of the base opening of the cage portion.

3. A stackable chimney cap according to claim 1, wherein each part further comprises an inner edge flange extending from the outer side flange section, the inner edge flange being bent inwardly so as to double the outer side flange section for enhanced rigidity.

4. A stackable chimney cap according to claim 3, wherein the inner edge flange has a notch adjacent one end and a connector tab at the other end, and wherein the connector tab of each part is received in the notch of the inner edge flange of the adjacent part and is fastened to the outer edge flange of said adjacent part.

5. A stackable chimney cap according to claim 1, wherein the side wall section of each part has a connector flange that is joined to a portion of the side wall of an adjacent part.

6. A stackable chimney cap according to claim 1, wherein a first pair of parts of the cage/base unit opposite each other are identical and a second pair of parts of the cage/base unit opposite each other and located between the parts of the first pair are identical.

7. A stackable chimney cap according to claim 1, wherein the cage/base unit is square in plan and the four parts are identical.

8. A stackable chimney cap according to claim 1, wherein at least one of said four parts includes a fastener-receiving tab extending from a top edge of the side wall section, and the hood is attachable to the cage/base unit by at least one fastener received through the at least one fastener-receiving tab.

* * * * *